US006070737A

United States Patent [19]

Russell et al.

[11] Patent Number: 6,070,737

[45] Date of Patent: Jun. 6, 2000

[54] SCREENING SYSTEMS AND METHODS FOR SCREENING PARTICULATE MATERIAL

[75] Inventors: Lynn A. Russell, Scappoose, Oreg.; Warren A. Strout, Whitter, Calif.

[73] Assignee: Western Wire Works, Inc., Portland, Oreg.

[21] Appl. No.: 09/000,721

[22] Filed: Dec. 30, 1997

[51] Int. Cl.[7] ..... B07B 1/34; B07B 1/38; B07B 1/49

[52] U.S. Cl. ..... 209/326; 209/332; 209/399

[58] Field of Search ..... 209/364, 365.1, 209/365.2, 399, 309, 325, 326, 331, 332, 366

[56] References Cited

U.S. PATENT DOCUMENTS

| | | | |
|---|---|---|---|
| 2,964,186 | 12/1960 | Ferrara | 209/366 |
| 3,221,877 | 12/1965 | Koning | 209/314 |
| 3,241,671 | 3/1966 | Brauchula | 209/243 |
| 3,454,162 | 7/1969 | Cover | 209/269 |
| 5,049,262 | 9/1991 | Galton et al. | 209/399 |
| 5,219,078 | 6/1993 | Hadden | 209/234 |
| 5,322,170 | 6/1994 | Hadden | 209/314 |
| 5,372,261 | 12/1994 | Galton et al. | 209/399 |
| 5,398,817 | 3/1995 | Connolly et al. | 209/399 |
| 5,816,412 | 10/1998 | Bokor | 209/326 |

FOREIGN PATENT DOCUMENTS

| | | |
|---|---|---|
| 0 631 825 A1 | 1/1995 | European Pat. Off. . |
| 1 322 014 | 7/1971 | United Kingdom . |
| 2 134 415 | 8/1984 | United Kingdom . |
| 2 247 850 | 3/1992 | United Kingdom . |

*Primary Examiner*—Donald P. Walsh
*Assistant Examiner*—Brett C. Martin
*Attorney, Agent, or Firm*—Marger Johnson & McCollom, P.C.

[57] ABSTRACT

The method and system of the present invention provides for fast, convenient and low cost installation and removal from a particulate screening assembly of an apparatus for protecting the underlying structural members of the screening assembly from the adverse affects caused by the flow therethrough of particulate material. The subject system includes a wear protector system designed for direct attachment to and removal from the structural members which support the screening assembly. This direct attachment and removal operation occurs without the need to detach or disassemble the support structure from the screening assembly. Thus, the wear protector system can be readily removed and replaced without expending substantial downtime in completing system maintenance.

26 Claims, 4 Drawing Sheets

SCREENING SYSTEMS AND METHODS FOR SCREENING PARTICULATE MATERIAL

BACKGROUND OF THE INVENTION

The invention relates to systems and methods for more effectively and efficiently screening particulate material, and more particularly to these screening systems in which the structure support members therefor are more effectively and efficiently protected from wear due to engagement by the particulate material during the screening operation.

Screening is the separation of aggregate particles into various sizes. Various conventional types of screens are used to separate aggregate including vibrating inclined screens, stationery inclined screens, vibrating grizzly screens, vibrating horizontal screens, rotary screens and static screens.

The vibrating inclined screen is the most popular of the screen types. Types of vibrating screens include those with two and four bearings, high speed screens, and screens which vibrate at the natural frequency of selected spring clusters. The majority of aggregate producers utilize a two or three deck vibrating screen with two bearings. The two bearing, circle throw, inclined screen utilizes a counter weight on a shaft to move the screen through approximately a ⅜ inch displacement throw. Screen throw varies inversely with the shaft speed with typical ranges from 800 to 950 rpm. The screen is isolated on springs and is customarily powered by an electric motor with a V-belt drive. Screen slopes vary from 15° to 30° for dry separations to slightly flatter for wet sieving.

The included vibrating screen is angularly adjustable to an inclined position to improved efficiency. Variations in slope, speed, stroke, and direction of rotation provide the flexibility required to determine the best combination of variables for making the separation. The inclined vibrating screen is typically used for aggregate separation. The addition of extra counterweights allow the screen to handle dense, coarse aggregate. When properly sized, the inclined vibrating screen performs virtually maintenance-free except for wear from the aggregate as it is processed. Horizontal screens are normally selected when conserving headroom or there is a need to maintain a lower profile. Variations in speed and stroke can be made for a given separation scheme.

The screening surface used in combination with a given vibrating screen must be strong enough to support the weight of the material, flexible enough to withstand the vibration, and provide enough open area to allow the desired throughput of aggregate. Various conventional screening decks and screening elements are known for this purpose.

The metal frame member system is designed to attach to the interior support members of a vibrating screen box. The vibrating screening boxes comprise a pair of vertically-extending sidewall members disposed in a vertical position in a parallel vertical plane. The rear vertically-extending edges of the sidewall members are joined one to the other by a vertically-extending rearwall member. The vibrating screening boxes are also held together by interior metal support members joined to the sidewalls and rearwall thereof. The metal frame member system which is non-integral is designed to attach to the metal support frame members. Once the metal frame system is in place attached to the interior of the vibrating screen box, the screening process can be conducted.

The above-described screen systems has a number of drawbacks. For example, the use of metal frame members causes several further problems. One of these problems is that they suffer from a substantial wear problem which results from impact and frictional engagement caused by the flow of aggregate material during the screening process. However, present commercially available systems for overcoming this wear problem do so at the expense of (a) extremely high replacement costs for the replacement materials and labor, and (b) extensive production downtime for completing the replacement process.

Accordingly, the need remains for a system which is low cost, fast, and convenient, which permits the effective and efficient replacement of screening system thereby avoiding excessive downtime, and, which substantially reduces the wear problems associated with the metal frame members.

SUMMARY OF THE INVENTION

The above-described needs have been met by the method and system of the present invention which comprises an effective and efficient system for protecting the metal frame members of a screening system thereby avoiding excessive downtime and for substantially reducing the wear problems associated with impact and frictional engagement to the metal frame members caused by the flow of aggregate material during the screening process.

The method and system of the present invention provides for fast, convenient and low cost installation and removal from a particulate screening assembly of an apparatus for protecting the underlying structural members of the screening assembly from the adverse affects caused by the flow therethrough of particulate material. The subject system includes a wear protector system designed for direct attachment to and removal from the structural members which support the screening assembly. This direct attachment and removal operation occurs without the need to detach or disassemble the support structure from the screening assembly. Thus, the wear protector system can be readily removed and replaced without expending substantial downtime in completing system maintenance.

The subject invention relates to a system and a method for screening particulate material. The system comprises a screening assembly including a housing defining an interior screening chamber. The screening assembly has a longitudinally-extending axis and a laterally-extending axis. Support members located within the confines of the interior screen chamber are joined to the housing for supporting for supporting said screen assembly. A frame member for supporting a plurality of screening modules is attached thereto. A plurality of screening modules are mounted for direct attachment to and removal from the screening assembly. Each screening module comprises means defining an array of sieve apertures of a predetermined size for allowing particulate material up to the predetermined size to pass through the screening module. The screening module is positioned on the frame so that particulate material passing through the screening module passes through the frame.

A protective covering system is employed to shield the support members and/or said frame member from impact and frictional engagement caused by the flow of aggregate material during the screening process. In this way, substantial wear problems to said support members and/or said frame member are avoided. The protective covering system is readily removable from the support members and/or said frame member to minimize production downtime.

The protective covering system is preferably self-interlocking to facilitate effective and efficient attachment and removability from the support members and/or the frame member. More specifically, the protective covering system can be fabricated so as to be attachable and removable from the support members and/or the frame member without the need to detach or disassemble the support members and/or the frame member. Preferably, the protective covering system defines a housing with which the support members and/or the frame member are located. Thus, the shape of the housing is complementary to the outer cross-sectional configuration of the support members and/or the frame member so that the support members and/or the frame member fits securely within the housing.

The protective covering system is preferably fabricated of a polymeric material, more preferably a flexible polymeric material. Preferably, the protective covering system defines a housing having a square, rectangular, circular, I-shaped or L-shaped cross-sectional configuration.

The preferred self-interlocking attachment of the protective covering system is typically provided by joining together complementary engaging portions of an interconnecting fastening system located in adjacent segments of the protective covering system. This is generally accomplished by a snap-fit interconnecting fastening system located in adjacent segments of the protective covering system.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
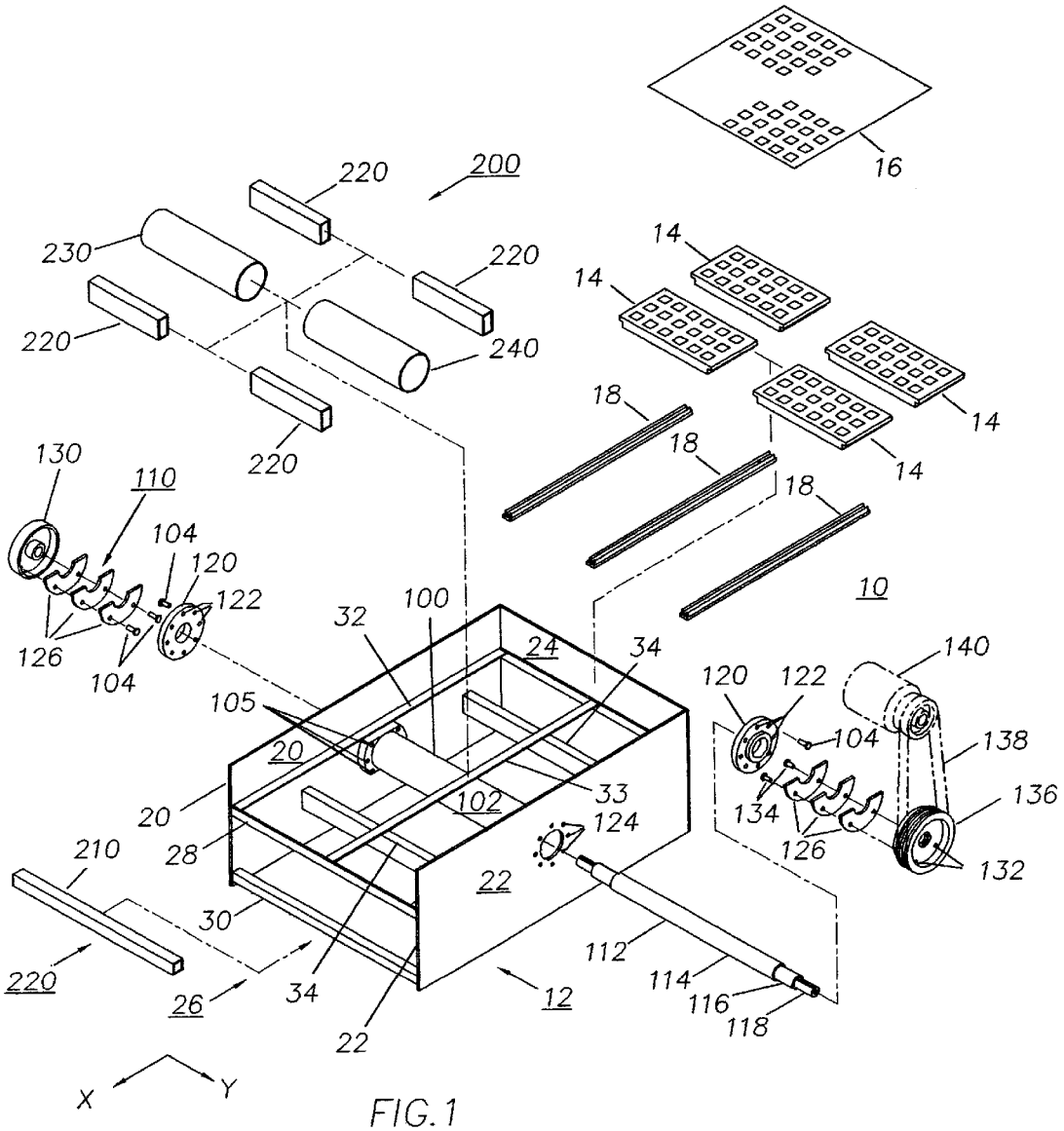
FIG. 1 is a perspective, exploded view of a vibrating screening system designed for attachment to a vibrating screening assembly, including perspective views of various forms of the self-interlocking protective covering system of the present invention.

Referring now to FIG. 1, a vibratory screening system denoted "10", comprises a vibrating screen assembly, denoted generally "12" including screening modules 14 or, alternatively, screening member 16 (see dotted line configuration). Vibrating screen assembly 12 comprises a longitudinal axis extending in the direction of the arrows denoted "X", and a lateral axis extending in the direction of the arrows denoted "Y".

The screening modules 14 typically are generally planar, having parallel inlet and outlet sides, and includes a grid defining an array of sieve apertures for allowing particulate material up to a size corresponding to the sieve aperture size to pass through the screening module. The grid is surrounded by a solid margin. The sieve aperture walls are slanted to enlarge the aperture on the outlet side of the module to prevent particulate material from lodging in the module. The module further includes a sidewall extending around the periphery of the module. An exemplary module is described in U.S. Pat. No. 5,049,262, which is incorporated herein by reference. The module 14 is typically fabricated from an impact-resistance polymeric material such as polyurethane or the like.

The screening module 16 is formed of a generally single-piece design. For example, the screening module 16 can be a grid-like array formed within a polymeric plate member or metal cross-members forming a grid-like pattern therewithin. The modules 14 or 16 are attached to the screening assembly 12 via intermediate rails 18 (see FIG. 1).

The vibrating screen assembly 12 depicted in FIG. 1 comprises first and second longitudinally-extending elongate sidewalls 20 and 22 which are vertically arranged and substantially parallel to each other, and laterally-extending elongate rear wall 24 which is vertically arranged and is substantially perpendicular to sidewalls 20 and 22. One end of each of the first and second sidewalls 20 and 22 is joined to the respective ends of rear wall 24 to define a rectangularly-shaped housing 18 therewithin. First and second sidewalls 20 and 22 and rear wall 24 typically comprise elongate flat metal plates and are joined together by conventional welding or mechanical fastening techniques.

The structural integrity of vibrating screen assembly 12 is reinforced by attaching a pair of structural mounting supports to the inner surfaces of first and second sidewalls 20 and 22 and rear wall 24 within housing 26. More specifically, the structural mounting support depicted herein includes an upper structural mounting support 28 and a lower structural mounting support 30. More specifically, upper and lower structural mounting supports 28 and 30 comprise longitudinally-extending structural members 32 and laterally extending structural mounting supports 34 which are joined one to the other and also to the inner surface of first and second sidewalls 20 and 22 and rear wall 24. Additionally, the upper structural support frame 28 includes longitudinally-extending crown bar 33 which is attached at one end to the inner surface of rear wall 24 and at the other end and at an intermediate point to laterally-extending structural mounting supports 34.

A system "100" for vibrating the screening modules 14 is also depicted in FIG. 1. System 100 comprises an eccentric drive shaft housing 102 which is joined by fasteners 104 to sidewalls 20 and 22. A conventional eccentric mechanism 110 is housed within the confines of eccentric drive shaft housing 102. This eccentric mechanism typically comprises a central drive shaft 112 having a central section 114, an intermediate section 116, and an end section 118. Section 116 is of a narrower diameter than section 114, and section 118 is of a narrower diameter than section 116. Furthermore, short end sections 118 are of a narrower diameter than intermediate sections 116, and intermediate sections 116 are of a narrower diameter than long central section 114. A pair of bearing housing flange assemblies 120, having a plurality of ball bearings contained therein, are mounted onto short intermediate sections 116. The bearing housing flange assemblies 120 include a plurality of apertures 122, which are patterned to align with corresponding apertures 124 located in sidewalls 20 and 22, are attached to sidewalls 20 and 22 and to housing 120 by fasteners 104. Eccentric counterweights 126, with apertures 128 located therewithin, are mounted on intermediate sections 116, and are offset to provide eccentric vibration for screen module 14. The balance wheels 130 and 134 include apertures 132, which are patterned to align with corresponding apertures 128 located in counterweights 126, the balance wheels 130 and 134, and the counterweights 126, are connected to each other by set screws 134. The balance wheel 134 includes a driven sheave 136 about which a pulley belt 138 is connected, the pulley belt 138 also being disposed about a drive motor 140 for providing rotary power to the eccentric mechanism.

Figure 5:
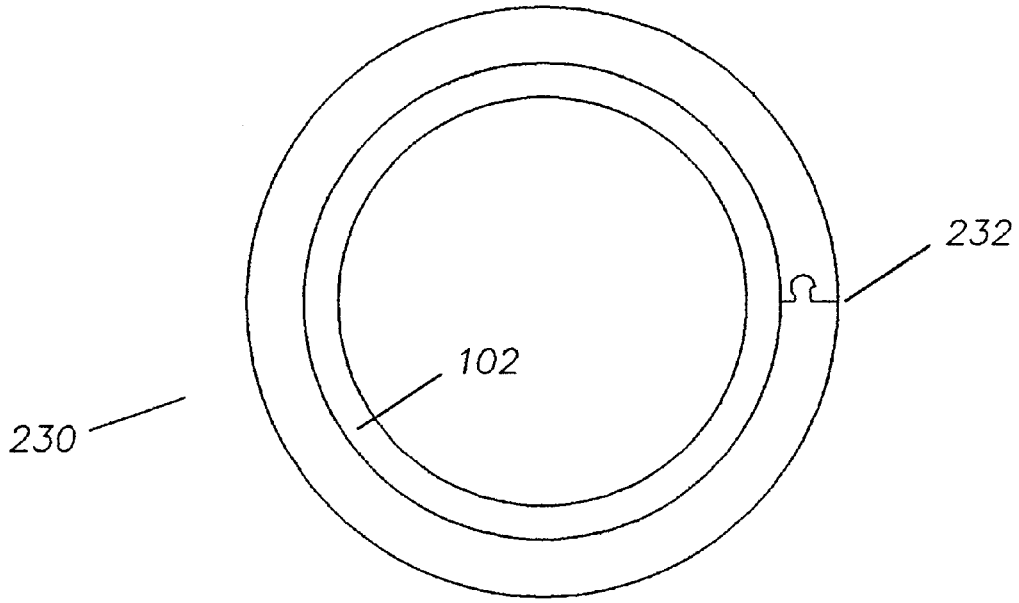
FIG. 5 is an enlarged end view of a protective covering system of the present invention having a circular cross-sectional configuration with a single self-interlocking connector in the closed position disposed about a circular support member of a screening system, such as the system depicted in FIG. 1.

The screen assembly employed herein can also be a static screening assembly (not shown), such as the static screening assembly 80 depicted in FIG. 5 of U.S. Pat. No. 5,769,240, which is incorporated herein by reference, and which is assigned to the same assignee as the assignee of the present patent application. In a static screening system the particulate material is fed thereto and is moved by gravity along a downwardly-descending set of screen modules without being assisted by the vibrating action of the screens depicted in FIG. 1 herein.

Referring now to FIG. 1, various forms of a self-interlocking protective covering system denoted generally "200" attach to various support members of the vibrating screening system 12 thereby forming a replaceable wear shield therefor. The particular self-interlocking protective covering systems 200 which are shown in FIG. 1 comprise a single-piece or a multi-section protective covering construction.

For instance, single-piece protective covering 210 has a rectangular cross-sectional configuration and is employed as a wear shield for laterally-extending lower structural mounting supports 30. Multi-section protective coverings 220 also have a rectangular cross-sectional configuration and are employed as a wear shield for laterally-extending upper structural mounting supports 34.

Figure 2:
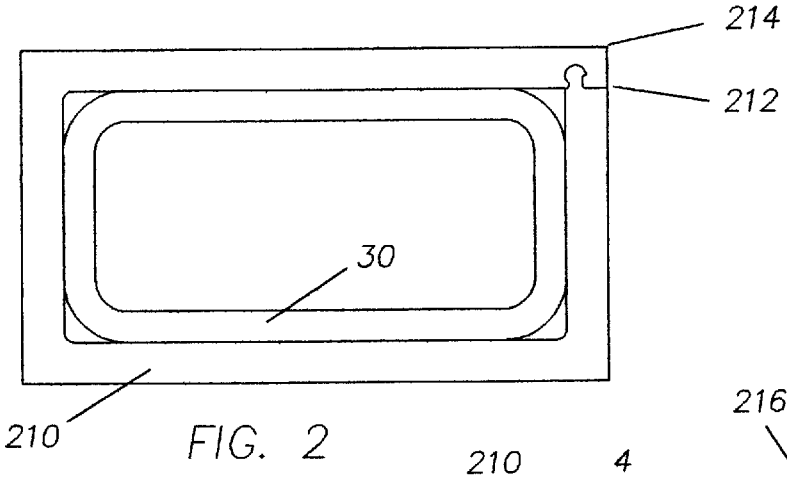
FIG. 2 is an enlarged end view of a protective covering system of the present invention having a rectangular cross-sectional configuration, the self-interlocking connector, located at a corner thereof, being in the closed position disposed about a support member of a screening system, such as the system depicted in FIG. 1.
Figure 3:
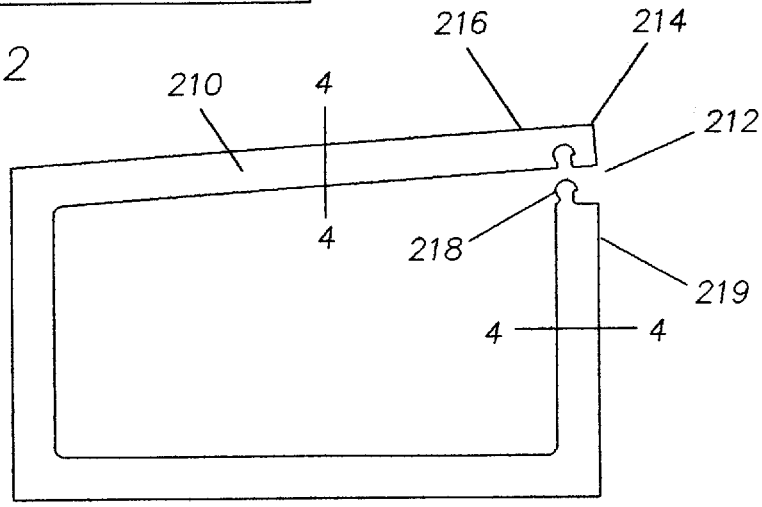
FIG. 3 is an enlarged end view of the protective covering system of FIG. 2, the self-interlocking connector being in the open position.
Figure 4:
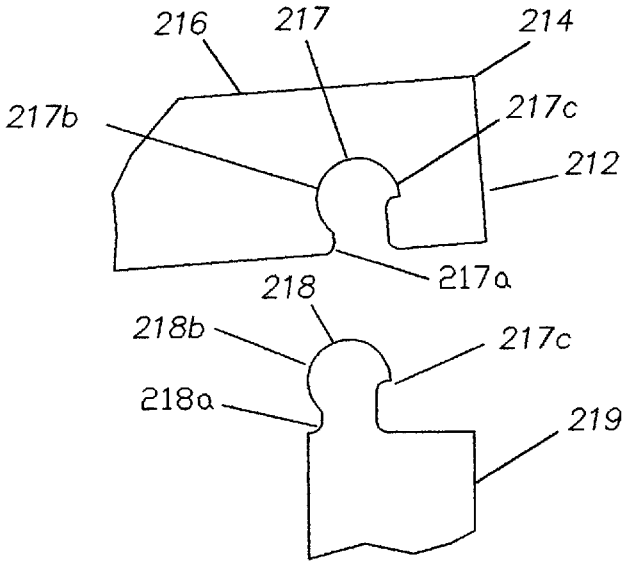
FIG. 4 is an enlarged fragmentary view of the self-interlocking connector taken along lines 4—4 of FIG. 3.

FIGS. 2–4 pictorially describe the interlocking aspects of protective covering system 210 having a rectangular cross-sectional configuration. In FIG. 2, the self-interlocking connector 212, located at a corner 214 thereof, and is shown in a closed position disposed about support member 30. The self-interlocking connector 212 comprises a snap-fit interconnecting fastening system located in adjacent segments 216 and 219 of connector 212. The snap-fit interconnecting fastening system includes an elongate interlocking recess 217 and a complementary elongate locking profile 218 which interlocking engage and disengage one from the other to facilitate the opening and closing of the connector 212. Preferably, the cross-sectional configuration of the recess 217 and the locking profile 218 are not symmetrical. As most clearly seen in FIG. 4, the cross-sectional configuration of recess 217 includes a narrowed neck 217*a*, a circular-shaped interlocking recess portion 217*b* and flange-shaped interconnecting recess portion 217*c*. The cross-sectional configuration of locking profile 218 includes complementary elements which comprise a narrowed stem 218*a*, a circular-shaped interlocking profile portion 218*b* and flange-shaped interconnecting profile portion 218*c*. The presence of the interconnecting profile portion 218*c* promotes and enhances the engagement of the locking profile 218 within the recess 217.

In FIGS. 3 and 4, the protective covering system 210 is shown in an open position. If the system 210 in the closed position about a support member has undergone excessive wear, the connector 212 is moved to an open position and adjacent segments 216 and 219 are disengaged one from the other. Then, the system 210 is removed from a position about the support member or frame member (see FIG. 1), without the need to detach or disassemble said support members and/or said frame member.

Figure 6:
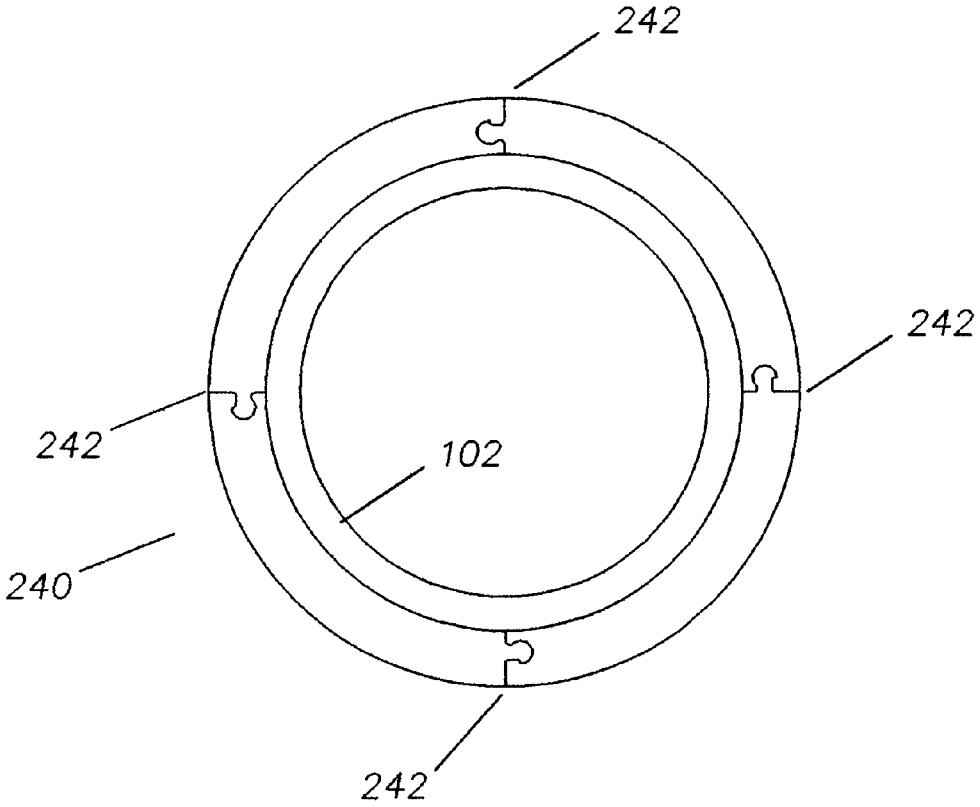
FIG. 6 is an enlarged end view of a protective covering system of the present invention having a circular cross-sectional configuration with a plurality of self-interlocking connectors in the closed position disposed about a circular support member of a screening system, such as the system of FIG. 1.

FIGS. 5 and 6 depict a protective covering system 230 and 240, respectively, having a circular cross-sectional configuration with a single self-interlocking connector 232 (FIG. 5) or a plurality (FIG. 6) of self-interlocking connectors 242 in the closed position disposed about circular support member 102 (see FIG. 1). Connectors 232 and 242 are of similar construction to connector 212 described above.

Figure 7:
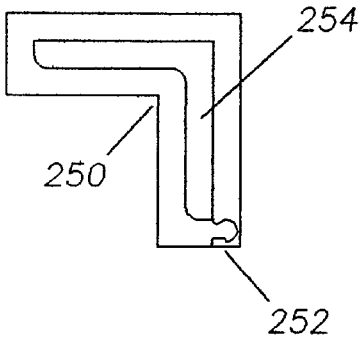
FIG. 7 is an enlarged end view of a protective covering system of the present invention having an L-shaped cross-sectional configuration with a single self-interlocking connector in the closed position disposed about an L-shaped support member of a screening system, such as the system of FIG. 1.

FIG. 7 is directed to a protective covering system 250 having an L-shaped cross-sectional configuration with a single self-interlocking connector 252, in the closed position, disposed about an L-shaped support member 254. Connector 252 is of similar construction to connector 212 described above.

Figure 8:
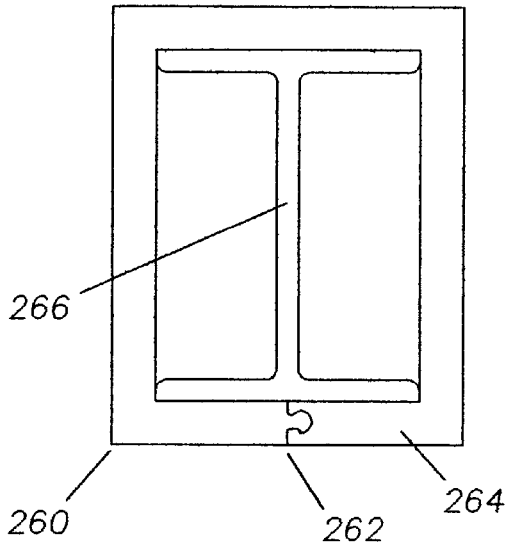
FIG. 8 is an enlarged end view of a protective covering system of the present invention having a rectangular cross-sectional configuration, the self-interlocking connector, located at a midpoint of one of the sides thereof, being in the closed position disposed about an I-shaped support member of a screening system, such as the system of FIG. 1.

FIG. 8 relates to a protective covering system 260 of the present invention having a rectangular cross-sectional configuration. In this case, a self-interlocking connector 262 is located at a midpoint of one of the sides 264 of the system 260. The system 260 is in a closed position disposed about an I-shaped support member 266.

Figure 9:
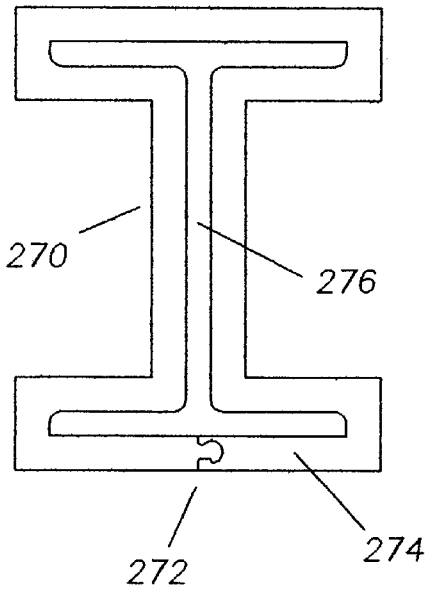
FIG. 9 is an enlarged end view of a protective covering system of the present invention having a I-shaped cross-sectional configuration, the self-interlocking connector, located at a midpoint of one of the sides thereof, being in the closed position disposed about an I-shaped support member of a screening system, such as the system of FIG. 1.

FIG. 9 shows a protective covering system 270 having a I-shaped cross-sectional configuration. The self-interlocking connector 272 is located at a midpoint of one of the ends 274 of the system 270. The connector 272 is in a closed position disposed about an I-shaped support member 276 of a screening system.

Having illustrated and described the principles of my invention in a preferred embodiment thereof, it should be readily apparent to those skilled in the art that the invention can be modified in arrangement and detail without departing from such principals. I claim all modifications coming within the spirit and scope of the accompanying claims.

We claim:

1. A screening system for screening particulate material comprising:

a screening assembly including a housing defining an interior screening chamber, the screening assembly having a longitudinally-extending axis and a laterally-extending axis;

support members located within the confines of the interior screen chamber and joined to the housing for supporting said screen assembly;

a frame member for supporting a plurality of screening modules attached thereto;

a plurality of screening modules mounted for direct attachment to and removal from the screening assembly, each screening module comprising means defining an array of sieve apertures of a predetermined size for allowing particulate material up to the predetermined size to pass through the screening module, the screening module being positioned on the frame so that particulate material passing through the screening module passes through the frame; and a self-interlocking protective covering system for shielding said at least one of said support members and said frame member resulting from impact and frictional engagement caused by the flow of aggregate material during the screening process thereby avoiding substantial wear problems to said at least one of said support members and said frame member, the protective covering system being readily removable from said support members and/or said frame member to minimize production downtime and to facilitate effective and efficient attachment and removability from either one of said support members and said frame member.

2. A screening system according to claim 1, wherein said protective covering system is attachable and removable without the need to detach or disassemble said support members and/or said frame member.

3. A screening system according to claim 2, wherein said protective covering system is attachable and removable without the need to detach or disassemble said at least one of said support members and said frame member.

4. A screening system according to claim 1, wherein the protective covering system defines a housing within which said at least one of said support members and said frame member are located, the shape of said housing being complementary to the outer cross-sectional configuration of said at least one of said support members and said frame member fits securely within said housing.

5. A screening system according to claim 1, wherein said protective covering system is fabricated of a polymeric material.

6. A screening system according to claim 1, wherein said protective covering system is fabricated of a flexible polymeric material.

7. A screening system according to claim 1, wherein said protective covering system defines a housing having a square, rectangular, circular, I-shaped or L-shaped cross-sectional configuration.

8. A screening system according to claim 1, wherein the self-interlocking attachment of said protective covering system is provided by joining together complementary engaging portions of an interconnecting fastening system located in adjacent segments of said protective covering system.

9. A screening system according to claim 1, wherein the self-interlocking attachment of said protective covering system is provided by a snap-fit interconnecting fastening system located in adjacent segments of said protective covering system.

10. A method of screening particulate material comprising:

providing a screening assembly, including a housing defining an interior screening chamber, the screening assembly having a longitudinally-extending axis and a laterally-extending axis, support members located within the confines of the interior screen chamber and joined to the housing for supporting said screen assembly, a frame member for supporting a plurality of screening modules attached thereto, and a plurality of screening modules mounted for direct attachment to and removal from the screening assembly, each screening module comprising means defining an array of sieve apertures of a predetermined size for allowing particulate material up to the predetermined size to pass through the screening module;

positioning the screening module on the frame so that particulate material passing through the screening module passes through the frame;

attaching a self-interlocking removable protective covering system onto at least one of said support members and said frame member, introducing a flow of said aggregate material to said plurality of screening modules, said flow of aggregate materials passing through the sieve opening and impacting and frictionally engaging the protective covering system which shields said at least one of said support members and said frame member during the screening process thereby avoiding substantial impact and wear problems to said at least one of said support members and said frame member; and when said protective covering system has undergone substantial impact or wear from said particulate material, removing said impacted, worn protective covering system from said at least one of said support members and said frame member and replacing it with another protective covering system.

11. A method according to claim 10, wherein said protective covering system is attachable and removable without the need to detach or disassemble said support members and/or said frame member.

12. A method according to claim 10, wherein said protective covering system is attachable and removable without the need to detach or disassemble said at least one of said support members and said frame member.

13. A method according to claim 10, wherein the protective covering system defines a housing within which said at least one of said support members and said frame member are located, the shape of said housing being complementary to the outer cross-sectional configuration of said at least one of said support members and said frame member so that said at least one of said support members and said frame member fits securely within said housing.

14. A method according to claim 10, wherein said protective covering system is fabricated of a polymeric material.

15. A method according to claim 10, wherein said protective covering system is fabricated of a flexible polymeric material.

16. A method according to claim 10, wherein said protective covering system defines a housing having a square, rectangular, circular, I-shaped or L-shaped cross-sectional configuration.

17. A method according to claim 10, wherein the self-interlocking attachment of said protective covering system is provided by joining together complementary engaging portions of an interconnecting fastening system located in adjacent segments of said protective covering system.

18. A method according to claim 12, wherein the self-interlocking attachment of said protective covering system is provided by a snap-fit interconnecting fastening system located in adjacent segments of said protective covering system.

19. A self-interlocking wear protector system for a particulate material screening system, said screening system comprising a screening assembly including a housing defining an interior screening chamber, support members located within the confines of the interior screen chamber and joined to the housing for supporting said screen assembly, a frame member for supporting a plurality of screening modules attached thereto, a plurality of screening modules mounted for direct attachment to and removal from the screening assembly, each screening module comprising means defining an array of sieve apertures of a predetermined size for allowing particulate material up to the predetermined size to pass through the screening module, the screening module being positioned on the frame so that particulate material passing through the screening module passes through the frame, said wear protector system comprising a self-locking structural member which covers said at least one of said support members and said frame member and shields same from the impact and frictional engagement caused by the flow of aggregate material during the screening process thereby avoiding substantial wear problems to said at least one of said support members and said frame member, the wear protector system being self-interlocking so as to facilitate effective and efficient attachment and removability from said at least one of said support members and said frame member without the need to detach or disassemble said at least one of said support members and said frame member.

20. A screening system according to claim 19, wherein said protective covering system is attachable and removable without the need to detach or disassemble said support members and/or said frame member.

21. A screening system according to claim 19, wherein the protective covering system defines a housing within which said at least one of said support members and said frame member are located, the shape of said housing being complementary to the outer cross-sectional configuration of said at least one of said support members and said frame member so that said at least one of said support members and said frame member fits securely within said housing.

22. A screening system according to claim 19, wherein said protective covering system is fabricated of a polymeric material.

23. A screening system according to claim 19, wherein said protective covering system is fabricated of a flexible polymeric material.

24. A screening system according to claim 19, wherein said protective covering system defines a housing having a square, rectangular, circular, I-shaped or L-shaped cross-sectional configuration.

25. A screening system according to claim 19, wherein the self-interlocking attachment of said protective covering system is provided by joining together complementary engaging portions of an interconnecting fastening system located in adjacent segments of said protective covering system.

26. A screening system according to claim 19, wherein the self-interlocking attachment of said protective covering system is provided by a snap-fit interconnecting fastening system located in adjacent segments of said protective covering system.

* * * * *